United States Patent [19]

Arai

[11] 3,940,761

[45] Feb. 24, 1976

[54] MEMORY MECHANISM

[75] Inventor: Kiyoyuki Arai, Tokyo, Japan

[73] Assignee: Copal Company Limited, Tokyo, Japan

[22] Filed: Dec. 5, 1974

[21] Appl. No.: 530,008

[30] Foreign Application Priority Data

Dec. 15, 1973 Japan..... 48-139320

[52] U.S. Cl...... 340/373; 340/378 R

[51] Int. Cl.[2]..... G08B 5/30

[58] Field of Search..... 340/373, 309.1, 309.4, 340/378 MW, 378 R

[56] References Cited

UNITED STATES PATENTS 3,798,640 3/1974 Dill..... 340/373 X

*Primary Examiner*—Harold I. Pitts

*Attorney, Agent, or Firm*—Oblon, Fisher, Spivak, McClelland & Maier

[57] ABSTRACT

A memory mechanism for controlling incremental change of informations in a plurality of information systems to be indicated successively in turn. The mechanism comprises actuation means adapted to be actuated in response to an input signal each time said actuation means receives such a signal, a first memory wheel operated by said actuation means to incrementally change the informations in the first system of said plurality of informations systems and having an intermittent transmission means, a first transmission wheel for engaging said intermittent transmission means, a second memory wheel including a second transmission wheel and adapted to incrementally change the informations in the second information system of said plurality of information systems, a first camming portion formed on said first memory wheel, second camming portions formed on said second memory wheel, lever means acting on said first and second camming portions and adapted to be operated during the lever means is in engagement with both said first and a selected one of said second camming portions and operation means operatively connected to said lever means to operate said first memory wheel so as to allow the first memory wheel to effect incremental information change in said first information system independent of said input signal during said lever is operating whereby incremental change of the informations in the first information system is controlled.

5 Claims, 3 Drawing Figures

MEMORY MECHANISM

BACKGROUND OF THE INVENTION

This invention generally relates to a memory mechanism and more particularly, to a memory mechanism which is adapted incrementally change or eliminate selected information of a plurality of informations each including a plurality of incremental informations whenever the informations in the one or more information systems are desired to be incrementally changed.

In a digital clock, for example, when the day and month indications are to be changed in increment, it is only necessary that the day indications ranging from the first day to the thirty-first day and the month indications ranging from January to December are cyclically repeated. However, the number of days of the month varies one month after another, that is, January has thirty-one days, February has twenty-eight or nine days, March has thirty-one days and April has thirty days, respectively, for example and thus, if the incremental month indication change cycle is merely related to the incremental day indication change cycle in such a manner that the month indication is changed by one increment at the end of the thirty-first day of the preceding month, there will be the delay time of three or two days if the month indication is changed from that of February to that of March, for example. And there will be also the delay time of one day when the month indication is incrementally changed from the indication of April to that of May. Thus, error will occur when the day and month indications are changed. In order to eliminate such error in changing the day and month indications when the month indication is changed in increment from that of an even month to that of the succeeding odd month, it is necessary that the month indication change is effected by skipping the day indications corresponding to the difference in number of days between the consecutive two months. As one example of the memory mechanisms for controlling the date indication change, the gear mechanism which utilizes the differential gear feeding has been developed by Solari & C.U. in Italy. However, the prior art memory mechanism has the disadvantages that the mechanism has a complicated construction and encounters difficulty in controlling incremental date change and adjustment.

SUMMARY OF THE INVENTION

The object of the present invention is to provide a memory mechanism which is simple in construction and reliable in operation and in which various memory wheels are operated in a predetermined mutual relationship by the utilization of an intermittent feed mechanism and cam means provided on the memory wheels to control the operation of the wheels whereby a selected information or informations are selectively changed or eliminated in one or more of a plurality of information systems each comprising a plurality of informations to be selectively changed or eliminated and controlled so that the indications of the informations in a desired information system or systems can be properly changed incrementally and cyclically.

The above and other objects and attendant advantages of the present invention will be more readily apparent to those skilled in the art from a reading of the following detailed description in conjunction with the accompanying drawings which show a preferred embodiment of the invention for illustration purpose only, but not for limiting the same in any way.

DETAILED DESCRIPTION OF THE PREFERRED EMBODIMENTS

The present invention will be now described referred to the accompanying drawings which show one application of the memory mechanism of the invention in which the memory mechanism is employed for cooperation with the date indication device of a digital clock.

Figure 1:
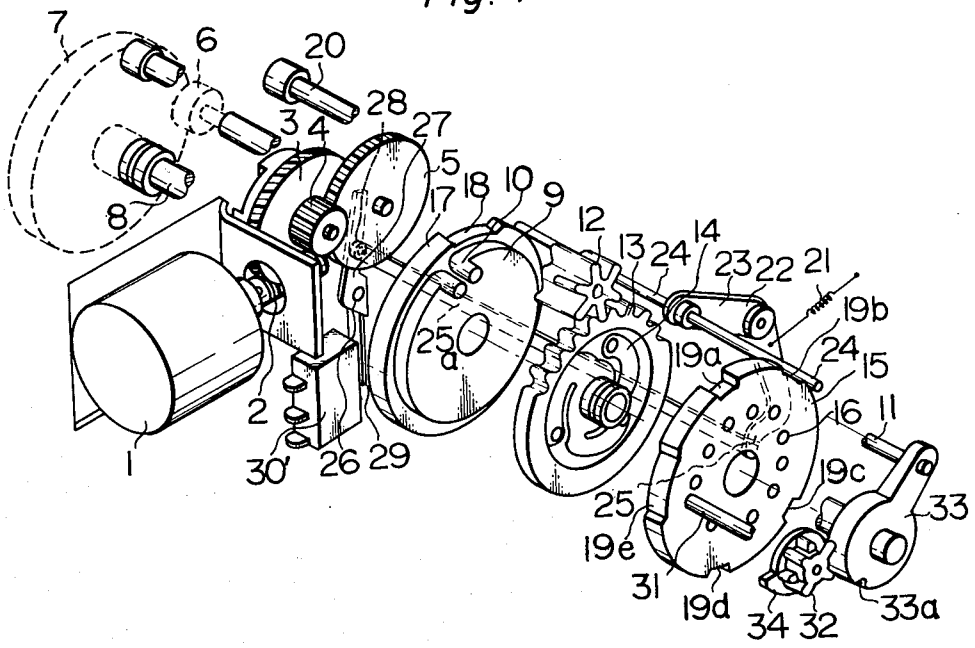
FIG. 1 is an exploded perspective view of essential parts of a preferred embodiment of the memory mechanism of the invention as being employed in a digital clock for cooperation with the date indication device in the clock.

First referring to FIG. 1, reference numeral 1 denotes an electric motor which is adapted to be actuated in response to an input signal generated in a control circuit (not shown) within a digital clock (not shown) at the end of a particular day or when the digital clock shows that the time has passed 11.59 p.m. of the day. The motor 1 has an output shaft having a worm 2 fixedly secured thereto and the worm is in meshing with a worm wheel 3 having a pinion 4 fixedly secured thereto. The pinion 4 is in meshing with a gear 5 with which a pinion 6 is coaxial for rotation together with the gear 5 and the pinion 6 is in meshing with a gear 7 to which a first memory wheel shaft 8 is fixedly secured. The shaft 8 has a first memory wheel 9 fixedly secured thereto. Thus, when the motor 1 is actuated or rotated in response to the above-mentioned input signal, the motor 1 rotates the first memory wheel shaft 8 through the transmission arrangement 2, 3, 4, 5, 6 and 7 to thereby rotate the first memory wheel 9 on the shaft 8. The first memory wheel 9 is adapted to take thirty-one days for making one complete rotation and thus, the first memory wheel 9 rotates by an angular distance corresponding to one thirtieth of its one complete rotation a day or each time the motor 1 is actuated. In other words, the fist memory wheel 9 makes one complete rotation when the above-mentioned input signal has been generated thirty-one times in the control circuit within the digital clock.

The first memory wheel 9 is interlocked with the day indication device (not shown) of the digital clock and when rotated, the first memory wheel causes the day indication device to give a day indication which varies day after day ranging from the first day to the thirty-first day of a particular month.

The first memory wheel 9 is formed with an intermittent transmission means 10 in a position thereof corresponding to the indication of the twenty-eighth day of the month, for example and the intermittent transmission means is in the form of projections extending from one side of the wheel 9 (the right-hand side as seen in FIG. 1) at right angles to the plane of the wheel side. The intermittent transmission means 10 is adapted to intermittently engage a star-shaped first transmission wheel 12 which is in turn rotationally mounted on a stationary shaft 11 which is parallel to the shaft 8. The first transmission wheel 12 is engaged by a second transmission wheel 13 which is rotatably mounted on the shaft 8 secured to the gear 7 so that the second transmission wheel 13 is rotated by an angular distance corresponding to one twelfth of its one complete rotation each time the first memory wheel 9 makes its one complete rotation on the assumption that the second transmission wheel makes one complete rotation a year. The second transmission wheel 13 includes a click mechanism 14 which is adapted to selectively engage a plurality of holes 16 arranged in the circumferential direction of a second memory wheel 15 mounted on the shaft 8 in such a manner that the angle of the click mechanism 14 relative to the holes 16 may be varied to thereby rotate the second memory wheel 15 together with the second transmission wheel 13.

Therefore, the second memory wheel 15 rotates by an angular distance corresponding to one twelfth of its one complete rotation a month or each time the first memory wheel 9 makes one complete rotation in thirty-one days. The second memory wheel 15 is interlocked with the month indication device (not shown) of the clock to cause the month indication device to give a month indication which varies month after month each time the second memory wheel rotates by an angular distance corresponding to one twelfth of its one complete rotation. Thus, the month indication change cycle is renewed every twelve months.

In this way, if every month of the year had thirty-one days, the above-mentioned mechanism would properly effect increment month and day indication changes.

However, in fact, the months of the year are not identical in the number of days and with respect to February, for example, after the indication of the twenty-eighth or twenty-ninth day, the month indication should be changed to the month indication of March and at the same time, the day indication should be also changed to the day indication of the first day of the month. Similarly, with respect to the months such as April, June, September and November, too, after the day indication of thirty-first day of each of their preceding months, the day indication should be changed to that of the first day of the month and at the same time, the month indication should be also changed to that of the next month.

For the purpose, according to the present invention, the first memory wheel 9 has a peripheral cam member 17 integrally formed with the periphery of the wheel and the peripheral cam member is formed with a first camming portion 18 in the position corresponding to the indications of the twenty-eighth and a half – thirty-first and a half days of the month and the second memory wheel 15 is formed as having the same diameter as the cam member 17. The periphery of the second memory wheel 15 is formed with a plurality of spaced second camming portions 19*a*, 19*b*, 19*c*, 19*d* and 19*e* in the positions corresponding to specific days of the various months having different numbers of days of the year, that is, the second camming portions correspond to the thirty and a half-thirty-first and a half days for each of the even months such as April, June, September and November of the year, to the twenty-eighth and a half - thirty-first and a half days for February of the common year and to the twenty-ninth and a half - thirty-first and a half days for February of the leap year, respectively.

Aligned contact bars 24 and 24 are fixedly secured to the end of one arm 23 of a lever 22 which is pivoted to a stationary shaft 20 and adapted to be urged in the counter-clockwise direction (as seen in FIG. 1) by a spring 21 and the contact bars 24 are adapted to be urged to selectively engage the first camming portion 18 and second camming portions 19*a*, 19*b*, 19*c*, 19*d* and 19*e*, respectively. An operation bar 25*a* is secured to the end of the other arm 25 of the lever 22 substantially in parallel to the bars 24 and abuts against a pin 28 on an actuator 27 pivoted to a stub shaft 26. The actuator 27 has a downwardly extending arm 29 and a limit switch 30 is provided adjacent to the arm 29 to be actuated by the actuator 27. Although the actuator 27 is normally urged away from the limit switch 30 by means of a spring (not shown), when the contact bars 24 of the lever 22 simultaneously engage the first camming portion 18 and a selected one of the second camming portions 19*a*, 19*b*, 19*c*, 19*d* and 19*e*, respectively, the lever 22 is urged to pivot in the counter-clockwise direction by the action of the lever 21 and the actuation bar 25*a* on the other arm 25 of the lever 22 pushes the pin 28 on the actuator 27 whereby the actuator 27 is urged in the clockwise direction as seen in FIG. 1 so as to cause the arm 29 of the actuator 27 to contact the limit switch 30 to actuate the switch.

The limit switch 30 is electrically connected to the energizing circuit (not shown) for the electric motor 1 and adapted to energize the motor independent of the above-mentioned input signal whenever the switch is actuated. When the motor 1 is energized, the first memory wheel 9 is rotated through the above-mentioned transmission arrangement and one of the contact bars 24 (the left-hand contact bar as seen in FIG. 1) is disengaged from the first camming portion on 18. As the contact lever 24 is disengaged from the first camming portion section 18 in the manner mentioned just above, the lever 22 is pivoted in the clockwise direction to rotate the first memory wheel 9 until the actuator 27 returns to the initial position in which the arm 29 of the actuator is not in engagement with the limit switch 30. Thus, by the shape and arrangement of the first and second camming portions as mentioned hereinabove, the day indication change can be properly effected in accordance with the number of days involved in a particular month and similarly, the month indication change can be also properly effected in keeping with the day indication change.

When the first and second camming portion 18 and second camming portions 19*a*, 19*b*, 19*c*, 19*d* and 19*e* are provided in the first and second memory wheels 9 and 15, respectively and the lever 22 is provided for cooperating with the first and second camming portions so as to selectively actuate the limit lever 22 as mentioned hereinabove a memory mechanism whereby the month indication change means designed for the months having thirty-one days therein can be also operated for effecting the month indication change for the other months having the number of days less than thirty-one days is provided.

With the construction and arrangement of the parts of the memory mechanism of the invention mentioned hereinabove, the day indication for the month of February always terminate at the day indication of the twenty-eighth day and the day indication is immediately changed to that of the first day. However, in practice, February in the leap year which comes every four years has twenty-nine days. Therefore, in order that the digital clock incorporating the abovementioned memory mechanism therein be properly operated for many years, the digital clock is also required to have the day indication change control function for the leap year.

Thus, according to another feature of the present invention, the day indication change for February and the month indication change from that of February to that of March in the leap year will be performed by the arrangement as will be described hereinbelow.

The second memory wheel 15 has a shaft 31 embedded therein and projecting laterally from one side therefrom in a position adjacent to the camming portion 19*e* corresponding to February in the periphery of the associated wheel and a third memory wheel 32 is rotatably mounted on the shaft 31. And as the second memory wheel 15 rotates, the third memory wheel 32 rotates in an epicyclic movement. A third transmission wheel 33 is rotatably mounted on the shaft 8 and has the free end fixedly secured to a stationary shaft 11 against rotation relative to the shaft 11. The third transmission wheel 33 has a notch 33*a* in the periphery and when any one of the teeth on the third memory wheel 32 engages the notch 33*a* on the third transmission wheel 33 as the second memory wheel 15 rotates and in consequence, the third memory wheel 32 rotates, the third transmission wheel 33 is rotated by an angular distance of one quarter of its one complete rotation. The third memory wheel 32 has a third camming portion 34 formed integrally therewith and the third camming portion 34 is so arranged that the camming portion 34 is brought to the position in which the camming portion covers a portion of the leading side of the second camming portion 19*e* in the second memory wheel 15 which is associated with February or the camming portion corresponding to the twenty-eighth and a half - twenty-ninth and a half days when the second memory wheel 15 rotates every four complete rotations.

When the third camming portion 34 is positioned in the second camming portion 19*e* as the second memory wheel 14 rotates every four complete rotations, the time when the right-hand contact bar 24 engages the second camming portion 19*e* is delayed by the time space corresponding to one day to thereby make it possible to indicate the twenty-ninth day for February and similarly, the change of the month indication from February to March can be also delayed by the time space corresponding to one day whereby the digital clock incorporating the memory mechanism of the invention can provide proper day and month indications for the leap year.

In the foregoing, description has been made of the application in which the memory mechanism of the invention is employed in conjunction with the date indication device of a digital clock, the memory mechanism is not necessarily limited to such an application, but can be broadly applied to an indication device having an increment indication change cycle for a plurality of information systems in which the informations to be changed should be controlled in such a manner that the informations are selectively changed or eliminated.

Figure 2:
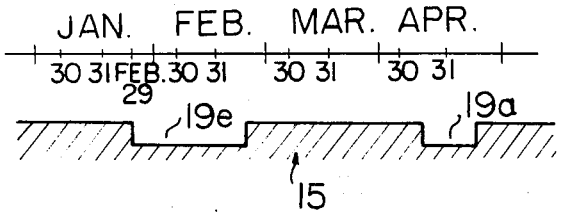
FIG. 2 is a fragmentary developed view on an enlarged scale of the second camming portions on the second memory wheel of the memory mechanism of FIG. 1.

FIG. 2 shows a portion of the second camming portions on the second memory wheel 15 in a developed enlarged scale view. The cooperation between these second camming portions 19*a* – 19*e* on the second memory wheel 15 and the first camming portion 18 on the first memory wheel 9 for operating the contact bars 24 has been described hereinabove.

Figure 3:
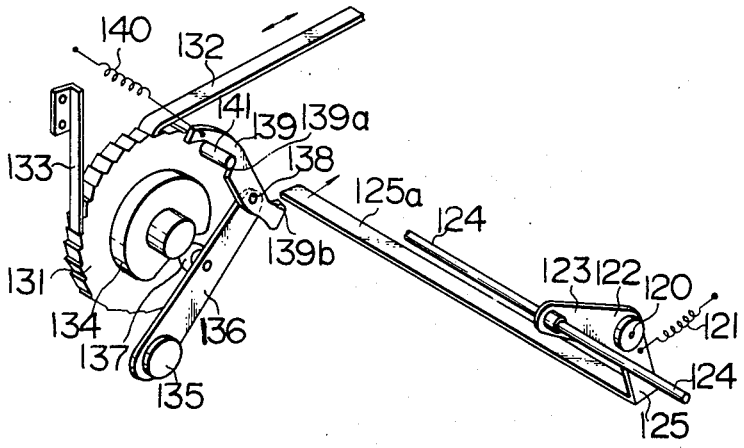
FIG. 3 is a fragmentary perspective view of a modification of the memory mechanism of FIG. 1.

FIG. 3 shows a modification of the memory mechanism of FIGS. 1 and 2 and in this modified form, the first memory wheel 9 is mechanically actuated by the lever 122 instead of by the lever-operated actuator 27 and limit switch 30 as shown in FIG. 1.

In the modification of FIG. 3, the lever 122, spring 121 and contact bars 124 have the same functions as described in connection with the corresponding parts in the mechanism of FIG. 1. As in the memory mechanism of FIG. 1, when the contact bars 24 engage the first camming portion 18 and any one of the second camming portions 19*a*, 19*b*, 19*c*, 19*d* and 19*e* (not shown in FIG. 3), the lever 122 is urged to pivot about the pin 120 in the clockwise direction as seen in FIG. 3 by the action of the spring 121 so as to move the actuation bar 125*a* of the lever in the arrow direction.

In the modified memory mechanism as shown in FIG. 3, instead of the electric motor 1 as shown in FIG. 1, there is provided a ratchet wheel 131 operatively connected to the first memory wheel 9 (not shown) and a feed pawl 132 adapted to engage the ratchet wheel for incrementally feeding the same is reciprocally moved in the arrow direction by an actuation device (not shown) which is operated in response to the above-mentioned input signal generated once a day so as to rotate or feed the ratchet wheel 131 by an angular distance corresponding to one thirty-first of its one complete rotation as the pawl 132 moves in its forward stroke of the reciprocal movement. For preventing the ratchet wheel 131 from rotating in the reverse direction as the pawl moves in its return stroke of the reciprocal movement there is provided a detent pawl 133.

The ratchet wheel 131 has a cam 134 formed integrally with one side thereof and a roller 137 rotatably supported on a lever 136 which is in turn pivoted at 135 is adapted to abut against the cam 134. Thus, as the ratchet wheel 131 is rotated, the roller 137 and in consequence, the lever 136 is pivoted about the pivot pin 135. The other end of the lever 136 pivotally supports a drive lever 139 by means of a pivot pin 138. A tension spring 140 is anchored to the other end of the drive lever 139 and for the period of time during which the ratchet wheel 131 is rotating by the angular distance corresponding to the indications of the first - twenty-eighth days of the month by the engagement between the cam 134 and roller 137, the pivotal lever 136 is pivoted in the clockwise direction as seen in FIG. 3 against the action of the tension spring 140 so as to tension the spring 140. The cam 134 is provided with a recess in the position corresponding to the indications from the twenty-ninth day of the preceding month to the first day of the succeeding month to allow the lever 136 to pivot in the counter-clockwise direction. However, the ratchet wheel 131 has a pin 141 in a suitable position on the side where the cam 134 is formed and the pin 141 is embedded in and projects from the cam so as to engage a shoulder 139*a* formed in the drive lever 139 when the ratchet wheel 31 has rotated to the position corresponding to the indication of the 28th day of the month. The drive lever 139 is formed at the end remote from the shoulder 139*a* with a hook 139*b* which is adapted to engage the actuation bar 125*a* of the lever 122 so as to prevent the lever 136 from pivoting in the counter-clockwise direction.

When the lever 122 is pivoted in the clockwise direction, the actuation bar 125*a* disengages from the hook 139*b* and allows the lever 136 to pivot about the pin 138 in the counter-clockwise direction by the energy stored in the tension spring 140 to thereby rotate the ratchet wheel 131 through the pin 141 engaged by the shoulder 139*a* on the drive lever 139 independent of the abovementioned input signal. In such a case, as described above in connection with the memory mechanism of FIG. 1, if the day indication of the twenty-eighth or ninth day of February is to be changed to that of the first day or alternately, the day indication of the thirtieth day of an even month is to be changed to that of the first day of the next odd month, the month indication is also simultaneously changed to that of the next month.

As clear from the foregoing description of the preferred embodiment of the invention, according to the present invention, there has been provided a memory mechanism which is simple in construction and reliable in operation and which can properly control incremental changes of informations in a plurality of information systems.

While preferred embodiments of the invention which are considered as best at the present time have been shown and described in detail, it will be understood that the same are for illustration purpose only and not to be taken as a definition of the invention, reference being had for the purpose to the appended claims.

I claim:

1. In a memory mechanism for controlling change of informations in a plurality of information systems each including information to be incrementally changed and indicated in succession, the improvement which comprises actuation means adapted to be actuated in response to a predetermined input signal whenever said actuation means receives such a signal, a first memory wheel operated by said actuation means to incrementally change the informations in the first system of said information systems until a cycle of incremental information change is completed and having an intermittent transmission means, a first transmission wheel for engaging said intermittent transmission means to be operated thereby, a second memory wheel including a second transmission wheel engaging said first transmission wheel to be operated thereby and adapted to incrementally change the informations in the second system of said plurality of information systems each time said first memory wheel has made one complete rotation so as to complete a cycle of incremental information change each time said second memory wheel makes one complete rotation, a first camming portion formed in at least one selected position of said first memory wheel, a second camming portion formed in at least one position of said second memory wheel, lever means urged to act on said first and second memory wheels and adapted to be operated during the lever is in engagement with both said first and second camming portions and operation means operatively connected to said lever means to operate said first memory wheel to allow the first memory wheel to effect incremental information change in said first information system during said lever means is operating independent of said input signal whereby incremental change of the informations in the first information system is controlled.

2. The memory mechanism according to claim 1, in which said actuation means is an electric motor and said operation means for said first memory wheel is a switch means connected to said motor for selectively energizing the motor.

3. The memory mechanism according to claim 1, in which said actuation means for operating said first memory wheel in response to said predetermined signal is a reciprocally movable feed pawl for operating ratchet means integrally formed with the first memory wheel and said operation means operatively connected to said lever means includes a pivotal lever engaging a cam formed on said ratchet means to be pivoted thereby, a drive lever pivoted to the free end of said pivotal lever and having at one end an engaging portion adapted to be engaged by said lever means and at the other end a shoulder engaging a pin formed on said ratchet means to incrementally feed said ratchet means in response to the pivotal movement of said pivotal lever in one direction and spring means connected to said drive lever and adapted to accumulate energy therein when said pivotal lever is pivoted in the direction opposite to said first direction by said cam and to incrementally feed said ratchet means by said drive lever in response to the pivotal movement of said pivotal lever when said spring means is disengaged from said drive lever by the operation of said lever means as said energy accumulated in said spring means is released.

4. The memory mechanism according to claim 1, in which the angular position of said second transmission wheel relative to said first memory wheel is adjustable whereby relative angular position between said first and second memory wheels is varied so as to change the indication of the information to be changed.

5. The memory mechanism according to claim 1, further including a third memory wheel rotatably mounted on a shaft provided adjacent to the periphery of said second memory wheel and adapted to move epicyclically as the second memory wheel rotates, a third transmission wheel engaging said third memory wheel to rotate the third memory wheel by a predetermined angular distance corresponding to a fraction of one complete rotation of the third memory wheel and a third camming portion integrally formed with said third memory wheel and adapted to be selectively brought to a position in which said third camming portion interferes with said second camming portion as the third memory wheel rotates by said predetermined angular distance whereby when said third camming portion is brought to said position in which the third camming portion interferes with the second camming portion, indication of information is changed.

* * * * *